US008135289B2

(12) United States Patent
Morimoto

(10) Patent No.: US 8,135,289 B2
(45) Date of Patent: Mar. 13, 2012

(54) IMAGE FORMATION APPARATUS, IMAGE FORMATION SYSTEM AND COMPONENT

(75) Inventor: Toshimitsu Morimoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 587 days.

(21) Appl. No.: 12/273,150

(22) Filed: Nov. 18, 2008

(65) Prior Publication Data

US 2009/0196633 A1 Aug. 6, 2009

(30) Foreign Application Priority Data

Feb. 4, 2008 (JP) ..... 2008-024222

(51) Int. Cl.
*G03G 15/00* (2006.01)
*G03G 15/08* (2006.01)

(52) U.S. Cl. ..... 399/12; 399/24; 399/27; 399/43

(58) Field of Classification Search ..... 399/12, 399/24, 25, 27, 262, 81, 43; 347/49, 86
See application file for complete search history.

(56) References Cited

U.S. PATENT DOCUMENTS

| | | | | |
|---|---|---|---|---|
| 7,734,198 | B2 * | 6/2010 | Higashiyama et al. | 399/12 |
| 2002/0164168 | A1 * | 11/2002 | Hayakawa | 399/12 |
| 2003/0031475 | A1 * | 2/2003 | Asakura | 399/12 |
| 2004/0120723 | A1 * | 6/2004 | Ito | 399/12 |

FOREIGN PATENT DOCUMENTS

| | | | |
|---|---|---|---|
| JP | 2004-220048 | | 8/2004 |
| JP | 2008-116630 | A * | 5/2008 |

* cited by examiner

*Primary Examiner* — Sophia S Chen
(74) *Attorney, Agent, or Firm* — K&L Gates LLP

(57) ABSTRACT

An image formation apparatus includes a receiving unit that is removably receiving a component, a determination unit that determines the acceptability of the component received in the receiving unit, and a control unit that, if the determination unit does not confirm the acceptability of the component, provides a notification and stops at least a portion of the image forming function at a predetermined time, after providing the notification.

9 Claims, 5 Drawing Sheets

IMAGE FORMATION APPARATUS, IMAGE FORMATION SYSTEM AND COMPONENT

INCORPORATION BY REFERENCE

This application is based upon and claims the benefit of priority from the corresponding Japanese Patent Application No. 2008-024222, filed Feb. 4, 2008, the entire contents of which is incorporated herein by reference.

BACKGROUND

1. Field of the Invention

The present invention relates to image formation apparatus and, more particularly, relates to an image formation apparatus to which a detachable component is mounted, such as a toner container.

2. Description of the Related Art

It is known to use toner, as development mediums, in image formation apparatuses, such as laser printers. The toner is typically housed in a container (cartridge).

When the amount of toner remaining in the toner container is sufficiently reduced, the user replaces the toner container with a new toner container. Recently, users have increasingly purchased and used inexpensive recycled toner containers supplied by toner replacement suppliers.

However, the toner that is charged into such recycled products is usually different from so-called genuine toners in terms of composition and quality. This thereby causes a degradation of printing quality, for example, the occurrences of black stripes, black dots and white dots.

Furthermore, some such toner can adhere and solidify on the printer rollers, thereby damaging photosensitive drums and the like.

Therefore, there have been suggested printers that are so constructed and arranged that when an improper toner container is mounted in the printer and detected, a predetermined warning is generated. Additionally, at the same time, operation of the printer is prevented. More specifically, these printers are constructed such that, when a toner in the container is removed, vacant data indicative of the fact that the toner has been finished is recorded in a memory or the like which is attached to the toner container. Thereafter, if the container is refilled with toner and inserted into the printer, when the printer extracts this data from the toner container, and the toner container is treated as a recycled product and the operation of the printer will be immediately stopped.

SUMMARY

As noted above, in situations where the use of so-called recycled toner products is prohibited in a printer, the use of the printer is also prevented until a "normal" toner component is ordered and the recycled product is replaced therewith. The present invention relates to an improvement of such systems.

An image formation apparatus according to an embodiment of the present invention comprises a receiving unit, a determination unit and a control unit. The receiving unit removably receives a component. The determination unit determines the acceptability of the component that is received in the receiving unit. The control unit, if the determination unit does not confirm the acceptability of the component, provides a notification and stops at least a portion of an image forming function at a predetermined time.

An image formation system according to another embodiment of the present invention comprises a component and an image formation apparatus that receives the component. The component includes an identification-information unit provided with information for use in determining the acceptability of the component to the image formation apparatus. The image formation apparatus includes a receiving unit, a determination unit and a control unit. The receiving unit removably receives the component. The extraction unit extracts the information from the identification-information unit when the component is received in the receiving unit. The determination unit determines the acceptability of the component based on the information extracted by the extraction unit. The control unit provides a notification and, stops at least a portion of image forming function at a predetermined time, if the determination unit does not confirm the acceptability of the component, Also, the present invention provides in another embodiment of a component removably received in an image formation apparatus that comprises an identification-information unit provided with information for use in determining the acceptability of the component to the image formation apparatus. If the component is received in the image formation apparatus, the information is provided to the image formation apparatus, allowing the image formation apparatus to determine whether or not the component is acceptable to the image formation apparatus.

Additional features and advantages are described herein, and will be apparent from the following Detailed Description and the figures.

DETAILED DESCRIPTION

An embodiment of the present invention will be described, with reference to FIGS. 1 to 5.

The present invention relates to an image formation apparatus (e.g., copier, printer, facsimile machine, multi function peripheral). The image formation apparatus operates by processes, devices and functions which are executed by a computer in response to commands from programs (software). The programs transmit commands to respective components of the computer to cause them to execute predetermined processing and functions, as will be described later. The programs and the computer constitute, in cooperation with each other, devices that, in an embodiment, allow the image formation apparatus to fully function.

The entirety or a portion of the programs can be provided by a magnetic disk, an optical disk, a semiconductor memory or other arbitrary computer-readable recording mediums. The programs can be read from such a recording medium, then are installed in the computer and are executed therein. On the other hand, the programs can be directly loaded to the computer through a communication line, without the use of a recording medium.

Figure 1:
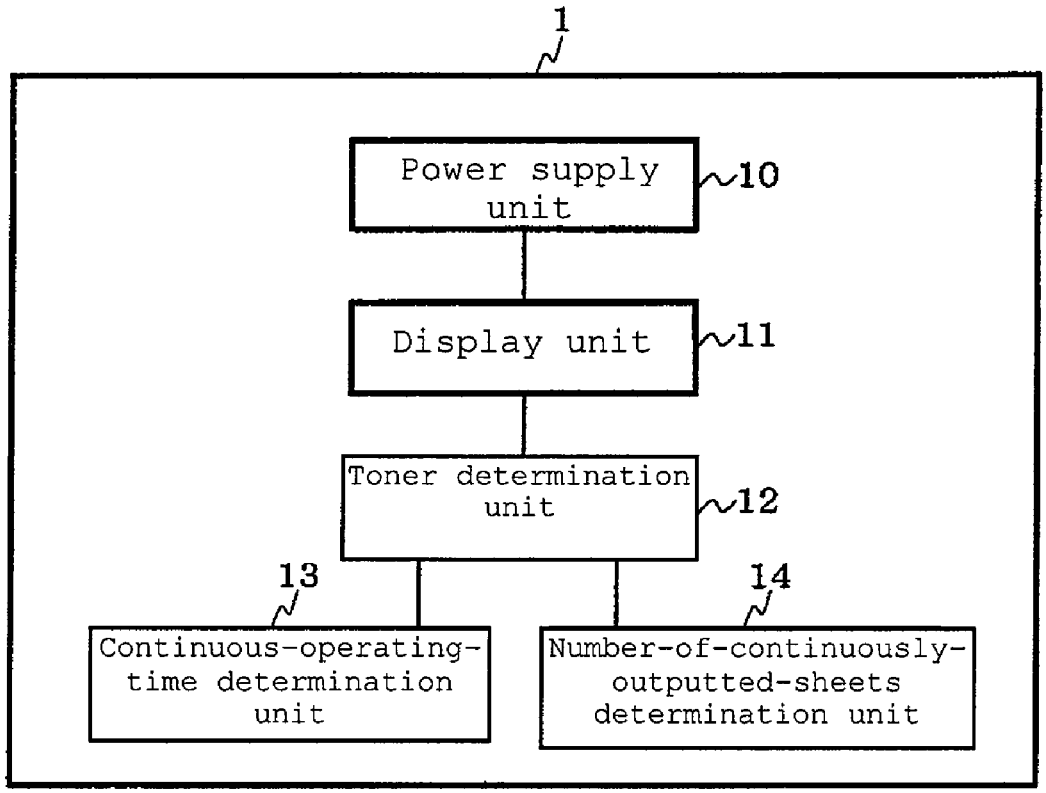
FIG. 1 is a functional block diagram illustrating the structure of an image formation apparatus according to an embodiment of the present invention.

FIG. 1 is a functional block diagram illustrating the structure of an image formation apparatus according to an embodiment of the present invention. As illustrated in the figure, the image formation device 1, according to an embodiment, includes a power-supply unit 10, a display unit 11, a toner determination unit 12, a continuous-operating-time determination unit 13 and a number-of-continuously-outputted-sheets determination unit 14.

In the illustrated embodiment, the power-supply unit 10 supplies electric power as a power source for the apparatus. The power-supply unit 10 also supplies electric power to the display unit 11, as illustrated in FIG. 1. The display unit 11 can be any type of a display such as a liquid crystal display and can provide a variety of information to users. In the illustrated embodiment, the power-supply unit 10 additionally functions to interrupt the supply of electric power to the main body, in cooperation with the continuous-operating-time determination unit 13 and the number-of-continuously-outputted-sheets determination unit 14.

In the present embodiment, when it is determined that the toner container 2 received in the apparatus is not acceptable (i.e., improper toner container 2 is used), the display unit 11 will display this fact, thereon, thereby notifying users of this fact. The toner determination unit 12 determines whether or not the received toner container 2 is acceptable and therefor constitutes the determination unit according to an embodiment of the present invention. More specifically, the toner determination unit 12 extracts, using a sensor 4 (an extraction unit) that is located in the main body, identification information from the toner container 2. The sensors extract identification information recorded in an RFID 3 attached to the toner container 2 and, then, determine whether or not the toner container is an acceptable product based on this information.

The identification information can either be data indicative of a "normal," non-recycled product which can be the date of manufacture or it can be data indicative of an improper recycled product, for example, a product which has is used. The toner identification unit 12 can determine the acceptability of the received toner container based on a determination as to whether or not identification information can be extracted and whether the extracted data is data indicative of a normal product or data indicative of an improper recycled product.

Figure 2:
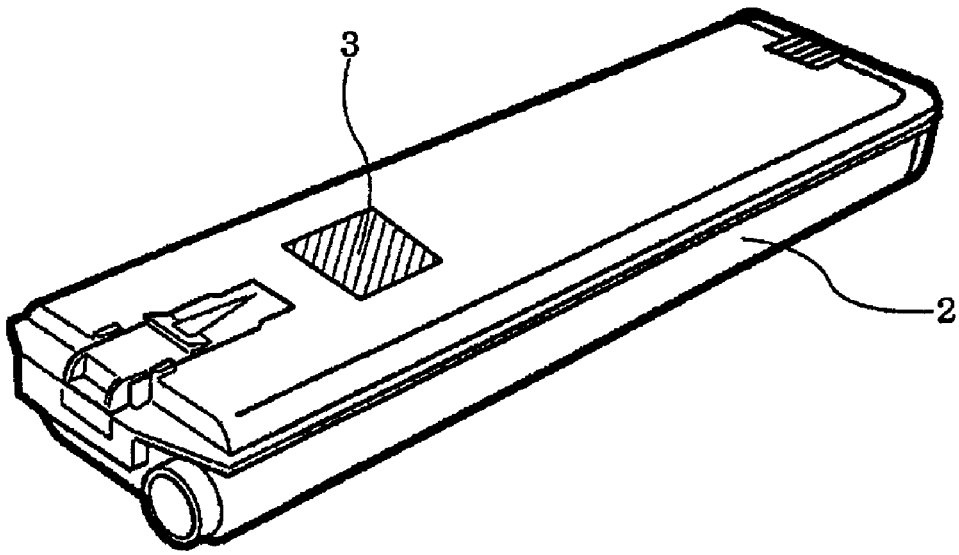
FIG. 2 illustrates a toner container having an RFID attached thereto, according to an embodiment of the present invention.
Figure 3:
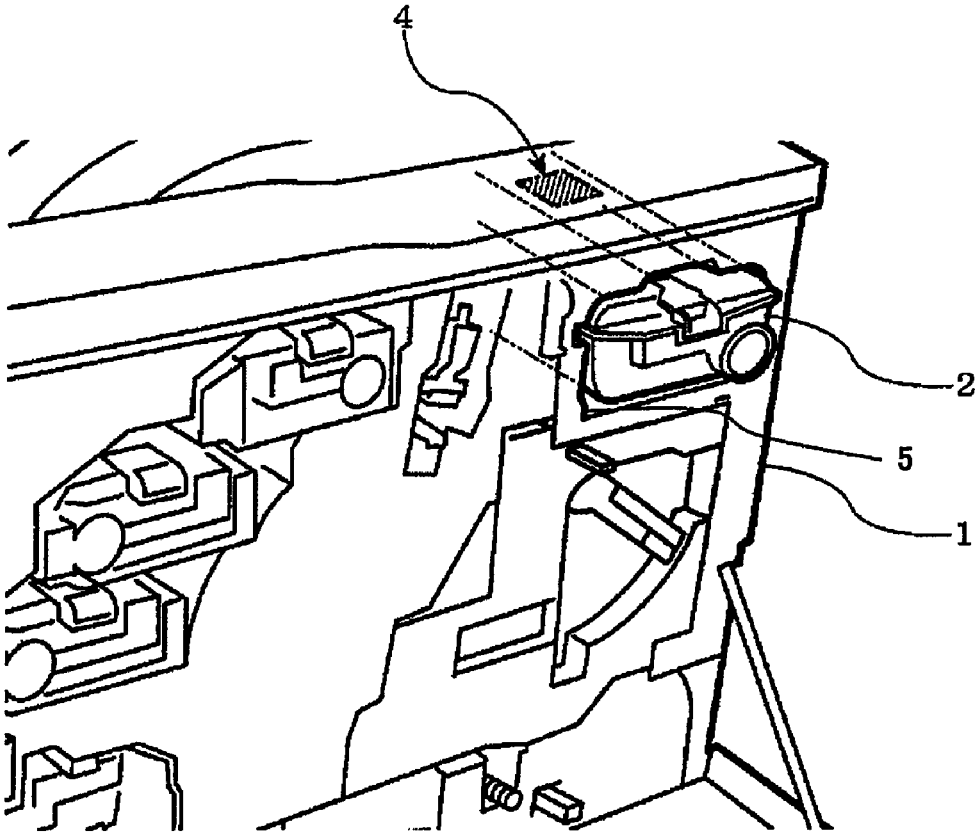
FIG. 3 illustrates a portion of the image formation apparatus having a sensor for reading the RFID on the toner container according to an embodiment of the present invention.

In use, the toner determination unit 12 detects, using a sensor 4, located in the main body as illustrated in FIG. 3, the RFID 3 attached to the toner container 2 (see FIG. 2). The sensor then attempts to extract the identification information from the RFID 3. When the identification information is extracted, the toner determination unit 12 compares the extracted identification information against a data base of dates of manufacture of "normal" products which have been stored in the image formation apparatus. This allows the unit 12 to determine the acceptability of the toner container 2. If the extracted identification information, such as the date of manufacture, agrees with information in the database, the acceptability of the toner can be confirmed.

Also, the number of times that the toner container 2 has been received in an image formation apparatus can be recorded in the RFID 3. Thus, the number of times the container 2 is received in a printer, for example, can be recorded. The recorded number of times that the toner container 2 has been received can then be checked against a predetermined permissible number (for example, a single time) which can be stored in the image formation apparatus. Thus, the acceptability of the toner container can be confirmed, in an embodiment, only when the number of times that it has been received is one (namely, when received for only the first time).

As noted previously, FIG. 2 illustrates the RFID 3 attached to a toner container 2. And FIG. 3 illustrates a portion of the image formation apparatus including the sensor 4 for reading the RFID 3 on the toner container 2. In FIG. 3, the toner container 2 has been received in the receiving unit 5 in the image formation apparatus 1.

As illustrated in these figures, the sensor 4 can be placed on the upper wall surface of the receiving unit 5. As illustrated, a portion thereof is oriented to face the RFID 3 on the toner container 2. This enables a reading of the RFID 3, when the toner container 2 has been received in the receiving unit 5.

Referring back to FIG. 1, the continuous-operating-time determination unit 13 controls the apparatus based on the elapse of a pre-set time interval. More specifically, the continuous-operating-time determination unit 13 measures the time which has elapsed since the toner determination unit 12 detected an improper toner container 2 or since the display unit 11 provided a predetermined notification. When the time exceeds the pre-set time interval, the unit 13 terminates the power supply of the apparatus, in cooperation with the power-supply unit 10.

The number-of-continuously-outputted sheets determination unit 14 controls the apparatus based on the number of outputted sheets. To this end, the number-of-continuously-outputted sheets determination unit 14 measures the number of sheets which have been outputted since the toner determination unit 12 detected an improper toner container 2 or since the display unit 11 provided a predetermined notification. When the number of outputted sheets exceeds a predetermined number of sheets, the unit 14 terminates the power supply of the apparatus, in cooperation with the power-supply unit 10.

It should be noted that the present invention is not limited to the aforementioned electric-power interrupting controls. Other controls can be used such as interrupting the output itself or invalidating user's operations, in cooperation with an output unit or an operation unit.

Further, these controls can be performed either when both the continuous-operating-time determination unit 13 and the number-of-continuously-outputted-sheets determination unit 14 have made relevant determinations or when only one of these units has made the determination. Also, it is possible to allow the system to enable normal operations, through predetermined user's operations, even when the operation of the image formation apparatus has been terminated.

Figure 4:
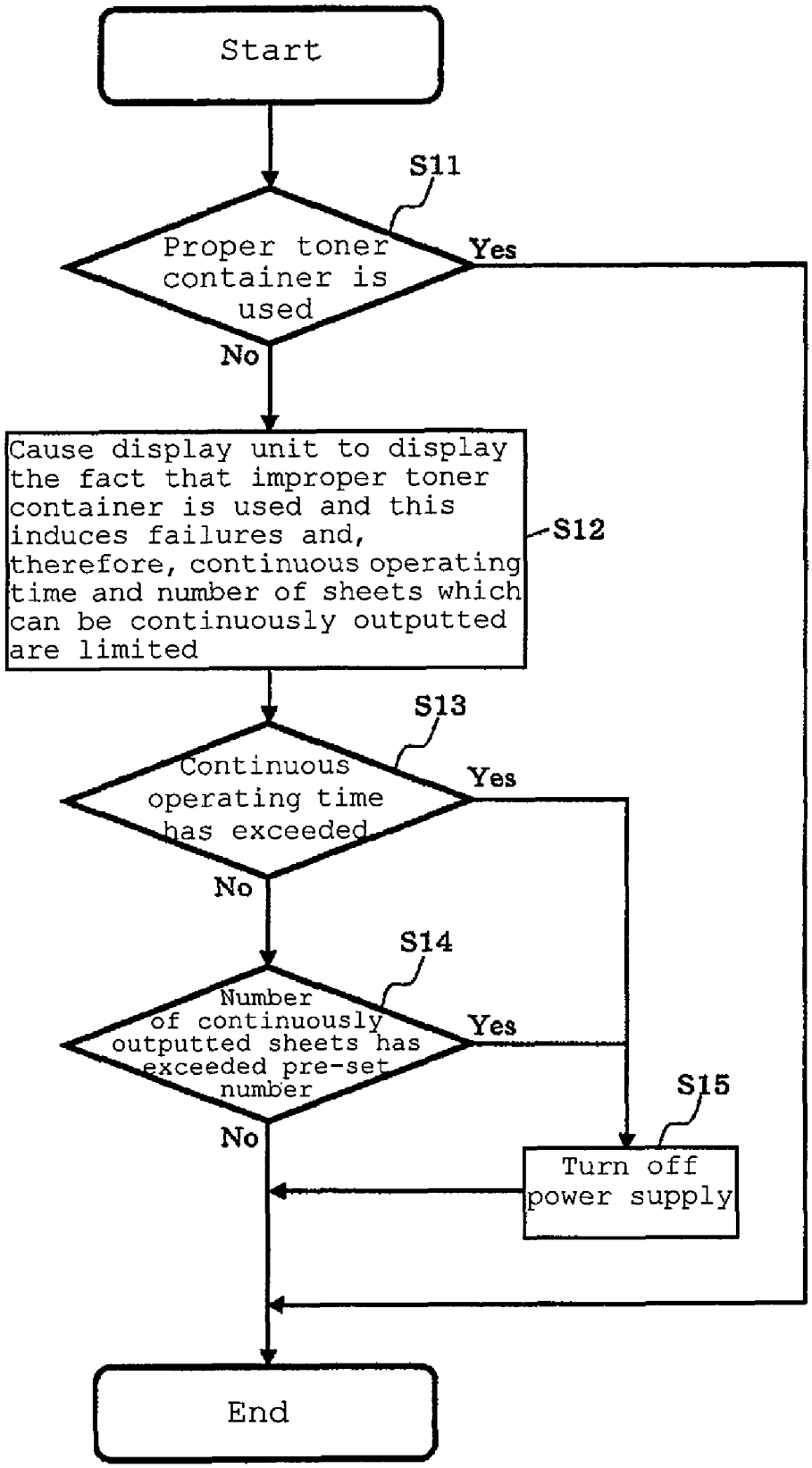
FIG. 4 is a flow chart illustrating a procedure which is performed when a toner container is received on the image formation apparatus according to an embodiment of the present invention.

Referring now to FIG. 4, there will be described an embodiment of a procedure which is performed when a toner container 2 is received in the image formation apparatus. FIG. 4 is a flow chart illustrating a control procedure which is performed when a toner container 2 is received in the image formation apparatus according to an embodiment of the present invention.

When a toner container 2 is received in the image formation apparatus, the toner determination unit 12 determines whether or not the container 2 is acceptable (S11). More specifically, the toner determination unit 12 extracts, using the sensor, the identification information recorded in the RFID 3 attached to the toner container 2. The unit 12 then determines whether or not the toner container is a normal product based on the identification information contained in the RFID 3. This determination can be based on various types of information, such as whether or not identification information can be extracted and whether the extracted data is indicative of a normal product or a recycled product.

Figure 5:
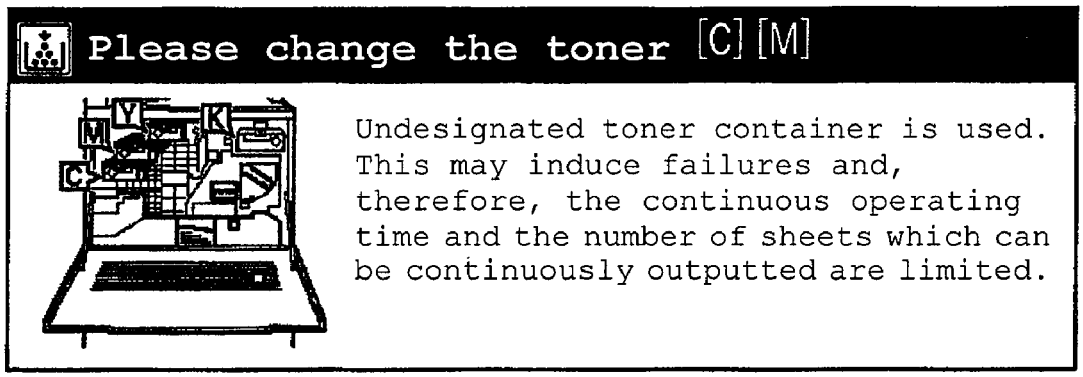
FIG. 5 illustrates an exemplary display that indicates that an improper toner container has been received in the image formation apparatus according to an embodiment of the present invention.

When it is determined, in step S11, that the toner container 2 is not acceptable, i.e., improper toner container 2 is used (S11: NO), the display unit 11 displays this fact, thereby notifying users (S12). For example, as illustrated in FIG. 5, the liquid crystal display or the like of the image formation apparatus 1 is caused to display a warning indicative of the fact that "an improper toner which may cause failures is used and, therefore, the continuous operating time and the number of sheets which can be continuously outputted are limited."

Of course, it goes without saying that, when the toner determination unit 12 determines in step S11 that the toner container 2 is acceptable (S11: YES), no particular notification will be provided and normal operations can be performed.

If an unacceptable unit is detected, the continuous-operating-time determination unit 13 and the number-of-continuously-outputted-sheets determination unit 14 start measuring the operating time and number of sheets respectively. Then, when the continuous-operating-time determination unit 13 determines that the continuous operating time has exceeded the pre-set time interval (S13: YES), the power-supply unit 10 stops the supply of electric power to the apparatus (S15). Further, when the number-of-continuously-outputted-sheets determination unit 14 determines that the number of continuously outputted sheets has exceeded the pre-set number (S14: YES), the power-supply unit 10 stops the supply of electric power to the apparatus (S15). On the other hand, until the continuous operating time exceeds the pre-set time interval and/or the number of continuously outputted sheets exceeds the pre-set number, the supply of electric power to the apparatus is not stopped, and a normal operation condition is maintained (S13: NO, S14: NO).

As described above, in the image formation apparatus 1 according to an embodiment, the toner determination unit 12 is adapted to determine whether or not the received toner container 2 is an acceptable product. When the toner determination unit 12 detects an improper toner container 2, a warning is provided to the user and, also, the elapsed time and the number of sheets output is then measured. When a predetermined time or number of outputted sheets is reached, the supply of electric power from the power-supply unit 10 will be stopped.

Thus, one can prevent the occurrence of malfunctions such as color unevenness due to the use of an improper toner container 2.

Pursuant to an embodiment of the present invention, even though an improper toner container 2 is detected, control of the system is such that the power supply is only cut off after the elapse of an adequate time interval, without immediately stopping the supply of electric power from the power-supply unit 10. Thus, the operation of the image formation apparatus 1 is stopped only after the user has sufficient time to recognize the fact that the toner container 2 is an unacceptable product and that continuous use of the toner container 2 will induce failures and the like.

Accordingly, with the image formation apparatus according to an embodiment of the present invention, it is possible to prevent the occurrence of malfunctions due to the use of an improper product, thereby realizing high reliability, without creating an issue that use of the printer is prevented until a normal product is ordered and the improper product is replaced therewith.

As described above, the image formation apparatus according to the present invention has been described with respect to a preferred embodiment, of course the image formation apparatus according to the present invention is not limited to only the aforementioned embodiment and can be implemented in various of types of embodiments within the scope of the present invention.

For example, in the embodiment, the component has been described as being a toner container, it can also be other components, such as a photosensitive drum.

In a general embodiment, the present invention can be described as follows. The image formation apparatus includes a receiving unit, a determination unit and a control unit. The receiving unit removably receives a component. The determination unit determines the acceptability of the component that is received in the receiving unit. The control unit, if the determination unit does not confirm the acceptability of the container, provides a notification and stops at least a portion of the image forming function at a predetermined time.

With the aforementioned structure, when an improper product is detected, the unit can be controlled in such a way so as to stop operation after providing to the user a warning of the fact that it has detected an improper product and that may induce malfunctions. This provides notice so the user recognizes this fact, but not in such a way as to immediately stop the device from functioning.

Accordingly, it is possible to prevent the occurrence of malfunctions due to the continuous use of such an improper product (e.g., a recycled product), without unnecessarily obstructing sale and/or purchase of so-called recycled products.

This facilitates use of the proper product, without creating the problem that the use of the printer is prevented until the proper product is obtained and the improper product is replaced therewith.

Further, in an image formation apparatus according to another embodiment of the present invention, the control unit may stop at least a portion of the function after at least one event selected from the group consisting of an elapse of a certain time interval and the printing of a certain number of sheets, after providing the notification.

Accordingly, it is possible to provide notification that an improper product has been received, thereby facilitating the replacement of the improper component. Further, it is possible to prevent malfunctions due to the use of the improper product by stopping the operation after the elapse of a certain time interval, and the like.

Of course, it is possible to adjust the elapsed time and/or the volume of printing that will be allowed before triggering a stop of the operation, according to the performance of the image formation apparatus.

The invention can facilitate the use of proper products without adversely impacting the consumer.

An image formation apparatus according to another embodiment of the present invention may comprise an extraction unit that, when the component is received in the receiving unit, extracts information for use in determining the acceptability of the component from the component. The determination unit then can determine the acceptability of the component based on the information extracted.

Accordingly, it is possible to easily determine the acceptability of the received component while effectively preventing the use of an improper product.

An image formation system according to another embodiment of the present invention comprises a component and an image formation apparatus that receives the component. The component includes an identification-information unit provided with information for use in determining the acceptability of the component to the image formation apparatus. The image formation apparatus includes a receiving unit, a determination unit and a control unit. The receiving unit removably receives the component. The extraction unit extracts the identification information from the identification-information unit when the component is received in the receiving unit. The determination unit determines the acceptability of the component based on the information extracted by the extraction unit. If an unacceptable product is detected, the control unit provides a notification and stops at least a portion of the image forming function at a predetermined time.

The control unit can be structured to stop at least a portion of the function after an event selected from the group consisting of an elapse of a certain time interval and the printing of a certain number of sheets, after providing the notification.

The present invention can be practiced as a system, as well as an image formation apparatus.

Also, a component according to another embodiment of the present invention comprises an identification-information unit provided with information for use in determining the acceptability of the component to the image formation apparatus. If the component is received in the image formation apparatus, information is provided to the image formation apparatus, allowing the image formation apparatus to determine whether or not the component is acceptable to the image formation apparatus. A preferable example of the component is a toner container. This can facilitate the determination as to whether or not the component is acceptable to the image formation apparatus, thereby providing an easy to implement method for preventing the improper use of an unacceptable container, such as generating a warning or stopping the operation of the apparatus.

Of course, it should be noted that the component, according to the present invention, can be adapted to various types of image formation apparatuses. Accordingly, the component is very versatile and has wide potential use.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image formation apparatus comprising:

a receiving unit that removably receives a component;

a determination unit that determines the acceptability of the component that is received in the receiving unit; and a control unit that, if the determination unit does not confirm the acceptability of the component, provides a notification and stops at least a portion of an image forming function at a predetermined time, wherein the control unit stops at least a portion of the function after at least one event selected from the group consisting of an elapse of a certain time interval; and the printing of a certain number of sheets, after providing the notification.

2. The image formation apparatus according to claim 1, comprising an extraction unit that, when the component is received in the receiving unit, extracts information for use in determining the acceptability of the component from the component, and wherein the determination unit determines the acceptability of the component based on the information extracted.

3. The image formation apparatus according to claim 1, wherein the component is a toner container.

4. The image formation apparatus according to claim 1, wherein the determination unit compares the extracted information against a data base of normal products.

5. The image formation apparatus according to claim 1, wherein the information is number of times that the component has been received, and wherein the determination unit checks the number of times against a predetermined permissible number.

6. An image formation system comprising:

a component;

an image formation apparatus that receives the component;

the component including an identification-information unit provided with information for use in determining the acceptability of the component to the image formation apparatus; and the image formation apparatus including, a receiving unit that removably receives the component, an extraction unit that extracts the information from the identification-information unit when the component is received in the receiving unit, a determination unit that determines the acceptability of the component based on the information extracted by the extraction unit, and a control unit that provides a notification and, stops at least a portion of the image forming function at a predetermined time, if the determination unit does not confirm the acceptability of the component, wherein the control unit stops at least a portion of the function after an event selected from the group consisting of: an elapse of a certain time interval; and the printing of a certain number of sheets, after providing the notification.

7. The image formation system according to claim 6, wherein the component is a toner container.

8. The image formation system according to claim 6, wherein the determination unit compares the extracted information against a data base of normal products.

9. The image formation system according to claim 6, wherein the information is number of times that the component has been received, and wherein the determination unit checks the number of times against a predetermined permissible number.

* * * * *